US009822744B2

(12) United States Patent
Bimbenet et al.

(10) Patent No.: US 9,822,744 B2
(45) Date of Patent: Nov. 21, 2017

(54) FUEL INJECTOR

(75) Inventors: Bruno Bimbenet, Saint Claude de Diray (FR); Richard Denis Jacques Alain Enters, Vineuil (FR); Eric Lecluse, Pezou (FR); Jean-Christophe Oge, Neuvy (FR); Thierry Thibault, Saint Ouen les Vignes (FR)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 505 days.

(21) Appl. No.: 13/879,529

(22) PCT Filed: Oct. 5, 2011

(86) PCT No.: PCT/EP2011/067400

§ 371 (c)(1),
(2), (4) Date: Apr. 15, 2013

(87) PCT Pub. No.: WO2012/052295

PCT Pub. Date: Apr. 26, 2012

(65) Prior Publication Data

US 2013/0193228 A1 Aug. 1, 2013

(30) Foreign Application Priority Data

Oct. 20, 2010 (EP) ..... 10188138

(51) Int. Cl.
*F02M 51/00* (2006.01)
*F02M 53/04* (2006.01)
(Continued)

(52) U.S. Cl.
CPC ..... *F02M 51/005* (2013.01); *F02M 53/04* (2013.01); *F02M 55/002* (2013.01);
(Continued)

(58) Field of Classification Search
CPC ..... B05B 1/24; B05B 15/00; F02M 51/005; F02M 55/002; F02M 55/004;
(Continued)

(56) References Cited

U.S. PATENT DOCUMENTS 2,459,286 A * 1/1949 Wiegand et al. ..... 313/11.5
5,372,313 A * 12/1994 Chabon et al. ..... 239/585.3
(Continued)

FOREIGN PATENT DOCUMENTS

EP 1130249 A2 9/2001
EP 1988276 A1 11/2008
(Continued)

OTHER PUBLICATIONS

International Search Report dated Mar. 11, 2011.

*Primary Examiner* — Arthur O Hall
*Assistant Examiner* — Christopher R Dandridge
(74) *Attorney, Agent, or Firm* — Joshua M. Haines

(57) ABSTRACT

An electrical module for use within a fuel injector for delivering fuel to an internal combustion engine is described. The electrical module has a variable length. The electrical module comprises electrical contacts for operatively connecting the electrical module to a power plug of a fuel injector. The electrical module also comprises an actuator for operatively controlling a control valve disposed within the fuel injector. The electrical module also comprises electrical conductors arranged within a protective housing. These electrical conductors provide an electrical connection between the electrical contacts and the actuator in order to provide electrical power to the actuator when the electrical contacts are operatively connected to the power plug of the fuel injector. The body of the electrical module is comprised of a compressible elastic element, such that the length of the module is variable by compressing the elastic element. Injectors including such electrical modules are also described.

13 Claims, 9 Drawing Sheets

(51) Int. Cl.
*F02M 55/00* (2006.01)
*F02M 61/20* (2006.01)

(52) U.S. Cl.
CPC ..... *F02M 55/004* (2013.01); *F02M 61/205* (2013.01); *F02M 2200/50* (2013.01); *Y10T 137/8376* (2015.04)

(58) Field of Classification Search
CPC .. F02M 53/04; F02M 61/205; F02M 2200/50; F02M 55/00; F02M 55/008; Y10T 137/8376
USPC ... 239/132, 132.1, 132.3, 132.5, 585.1, 584, 239/583, 579, 574, 128, 13, 5, 8, 418; 123/533
See application file for complete search history.

(56) References Cited

U.S. PATENT DOCUMENTS 6,172,445 B1 * 1/2001 Heinz ..... F02M 47/027 310/328
6,279,842 B1 8/2001 Spain
7,191,963 B2 * 3/2007 Cobianchi ..... F02M 47/027 239/585.1
8,100,344 B2 * 1/2012 Kondo ..... F02M 47/027 123/480
8,201,754 B2 * 6/2012 Chang ..... F02M 63/0225 239/132
8,224,554 B2 * 7/2012 Kondo et al. ..... 701/104
8,925,524 B2 * 1/2015 Cooke ..... 123/472
2008/0185461 A1 * 8/2008 Fleig ..... F02M 51/005 239/585.1
2008/0272214 A1 11/2008 Male et al.
2009/0140072 A1 * 6/2009 Venkataraghavan ..... H01L 41/0536 239/102.2
2009/0277423 A1 * 11/2009 Cooke ..... F02M 45/086 123/494
2010/0102143 A1 4/2010 Magel
2011/0186647 A1 8/2011 Bernhaupt et al.
2012/0080011 A1 * 4/2012 Cooke ..... F02M 45/086 123/472

FOREIGN PATENT DOCUMENTS

WO 2009/023887 A1 2/2009
WO WO2009023887 * 2/2009 ..... F02M 53/04

* cited by examiner

FUEL INJECTOR

CROSS REFERENCE TO RELATED APPLICATIONS

This application is a national stage application under 35 U.S.C. 371 of PCT Application No. PCT/EP2011/067400 having an international filing date of 5 Oct. 2011, which designated the United States, which PCT application claimed the benefit of European Patent Application No. 10188138 filed 20 Oct. 2010, the entire disclosure of each of which are hereby incorporated herein by reference.

TECHNICAL FIELD

The present invention relates to an improved design for a fuel injector for use in the delivery of fuel to a combustion space of an internal combustion engine. In particular aspects, the design relates to an electrical module for use in such a fuel injector.

BACKGROUND TO THE INVENTION

Conventional prior art fuel injectors feature a hydraulic needle valve which is activated to inject fuel into the combustion chamber of the engine. In activation of the needle valve, a volume of fuel does not reach the combustion chamber but instead is circulated back through the fuel injector—there may also be a flow channel permanently available for circulation back of a proportion of the fuel. This returned volume of fuel is conventionally referred to as "back leak" fuel, and introduces several technical issues, discussed below, which degrade the performance of the prior art fuel injectors.

Typically, a fuel injector includes an injection nozzle having a nozzle needle which is movable towards and away from a nozzle needle seating so as to control fuel injection into the engine. The nozzle needle is controlled by means of a control valve, which controls fuel pressure in a control chamber for the nozzle needle. Typically, opening the control valve decompresses the control chamber, which consequently opens the injection nozzle and fuel is injected into the combustion chamber. During decompression of the control chamber, a volume of fuel, which is required to maintain the pressurised environment within the control chamber when the control valve is in a closed state, is ejected as a back leak fuel flow from the fuel injector.

This back leak fuel flow may be at a very high pressure and temperature. Often the pressure may be of the order of hundreds of bar, or depending on the application can even reach thousands of bar (e.g. up to 2500 bar in some designs). As a result of these extreme pressures several issues arise during the operation of the fuel injector, which deteriorate the performance of the fuel injector.

Typically, prior art solutions involve the drilling of one or more conduits within the fuel injector body, providing one or more channels along which the back leak fuel may be evacuated from the control chamber, and returned to the fuel management system for use in a subsequent combustion cycle. By fuel management system is intended the plurality of apparatus required to deliver fuel to the fuel injectors, which comprises the fuel tank, the assortment of pumps required to direct fuel to the fuel injectors, and the electronic control unit (ECU) which monitors the engine performance, and ensures the required volume of fuel is delivered to each fuel injector. Managing the back leak fuel flow in the manner described above introduces several problems, which over the course of time lead to a deterioration in the performance of the injector.

One problem commonly associated with back leak fuel flow is that of general wear to the surrounding apparatus, and in particular wear within the back leak flow channel, due to the volume and the high pressure of the back leak fuel flow passing through the channel over time. These problems are exacerbated by the formation of deposits and other sediment, which tend to coagulate within the one or more channels.

The back leak flow conduit is typically a bore of narrow diameter machined within the body of the fuel injector. The machining of the back leak flow conduit presents significant difficulties during manufacture due to the relative small diameter of the injector body and the material of the body. Often the injector body is comprised of several different components with the back leak channel running through the components. This requires a very high and accurate level of machining to ensure that the back leak channel is perfectly aligned in each of the components. Accordingly, the specialised nature of the machining work required contributes significantly to the production cost.

Alternative back leak channel designs are disclosed in WO 2009/023887 (corresponding to U.S. Patent Application Publication 2011/0186647), EP 1130249 (corresponding to U.S. Pat. No. 6,279,842), and DE 10 2007 011789 (corresponding to U.S. Patent Application Publication 2010/0102143). WO 2009/023887 discusses the use of unpressurized fuel to flush an injector assembly, and EP 1130249 shows a magnetostrictive rod controlled injector in which some fuel is allowed to leak for cooling purposes through the injector assembly.

Currently, all the major components housed within a fuel injector are purpose-built for the injector in which they are to be used, and components built for use in one model and/or size of fuel injector are not cross-compatible for use within different fuel injectors, due to the different dimensions of the fuel injectors, and therefore the different dimension of required component. This lack of cross-compatibility is a serious issue for manufacturers of fuel injectors, in so far as separate production lines of component are required for each different model of fuel injector, inevitably increasing production costs and time.

It is an object of the present invention to resolve the aforementioned issues commonly associated with prior art fuel injectors.

SUMMARY OF THE INVENTION

The present invention provides an electrical module for use within a fuel injector for delivering fuel to an internal combustion engine, the electrical module being of variable length and comprising: electrical contacts for operatively connecting the module to a power plug of the fuel injector; an actuator for operatively controlling a control valve disposed within the fuel injector; electrical conductors arranged within a protective housing, the electrical conductors providing an electrical connection between the electrical contacts and the actuator, to provide electrical power to the actuator when the electrical contacts are operatively connected to the power plug of the fuel injector; wherein the body of the module is comprised of a compressible elastic element, such that the length of the module is variable by compressing the elastic element.

Advantageously, the elastic element is a coil spring. In alternative embodiments, the elastic element may be a spring washer.

In a further inventive aspect, there is provided a fuel injector for use in delivering fuel to an internal combustion engine, the fuel injector comprising: an injector body, the injector body comprising a first conduit; an electrical module arranged within the first conduit, the module comprising an actuator and electrical connections. The injector body is disposed within the fuel injector such that a back leak channel form the fuel injector passes through at least a part of the first conduit.

Advantageously in this aspect, the length of the electrical module is variable. The module may comprise: electrical contacts for operatively connecting the module to a power plug, the power plug being disposed with one or more electrical connections arranged in use to provision the electrical module with electrical power. The body of the module comprises a compressible coil spring such that the length of the module is variable.

Advantageously, the electrical module in this further inventive aspect is an electrical module as provided in accordance with embodiments of the present invention.

The width of the first conduit is selected such that a clearance is formed between the walls of the first conduit and the electrical module to allow the passage of the back leaked fuel flow through the formed clearance.

In an alternative embodiment the injector body is provided with a second conduit, the second conduit being arranged in use to provide an input passage through the injector body for a second fuel flow. The second fuel flow being for use in mixing with the back leaked fuel flow to form a back leak fuel flow mixture. The back leak fuel flow mixture is directed through at least a part of the first conduit.

The fuel mixture comprises the back leaked fuel flow generated within the fuel injector by opening of a control valve, and the input second fuel flow provided by a fuel source located external to the fuel injector.

The back leak fuel mixture is for use in cooling one or more of the following: a) the electrical module; b) the actuator; c) the injector body.

In an embodiment the back leak fuel flow outlet is positioned on the power plug, the power plug being disposed with one or more electrical connections arranged in use to provision the electrical module with electrical power, and a hermetic seal to prevent contact between the back leaked fuel flow and the one or more electrical connections. The back leak fuel outlet is arranged in use to enable ejection of the back leak fuel flow from the first conduit.

Alternatively, the back leak fuel flow outlet is positioned on the injector body, and the injector body is disposed with a third conduit joined to the first conduit. The fuel flow outlet being arranged in use to enable ejection of the back leak fuel flow from the first conduit via the third conduit. The first conduit is disposed with a hermetic seal to prevent the passage of back leaked fuel from the first conduit to a power plug. The power plug being disposed with one or more electrical connections arranged in use to provision the electrical module with electrical power.

This aspect also relates to a method of cooling the components within a fuel injector, the fuel injector being for use in delivering fuel to an internal combustion engine. The fuel injector comprising an injector body disposed with a first conduit, the method comprising: mixing within the fuel injector a back leak fuel flow with an input second fuel flow; and cooling the components by directing the fuel mixture within the first conduit during operation of the fuel injector.

The components within the fuel injector comprise an electrical module comprising an actuator, the electrical module being arranged within the first conduit. The electrical module is cooled by the fuel mixture.

In a further embodiment the fuel mixture comprises the back leaked fuel flow generated within the fuel injector by the opening of a control valve; and an input second fuel flow provided by a fuel source located external to the fuel injector. The second fuel flow is input via a second conduit disposed within the injector body.

A still further inventive aspect relates to an injector body component of a fuel injector, wherein the injector body is disposed with a conduit, the conduit being arranged in use to house an electrical module comprising an actuator, and to provide a channel for a back leak fuel flow.

In a further embodiment the injector body is disposed with a second conduit, the second conduit being arranged in use to provide a channel for a second fuel flow.

A significant benefit provided by one aspect described above, in comparison to traditional fuel injectors featuring a separate back leak fuel flow conduit, is the simplicity of manufacture. This is due to the use of the first conduit, which houses the electronics module comprising the actuator, for the circulation of the back leak fuel flow, and renders the drilling of a purpose-built back leak fuel flow conduit unnecessary.

Another significant benefit associated with an aspect described above—namely, mixing of the back leak fuel flow with an input fuel flow to create a back leak fuel flow mixture, and directing the mixture within the first conduit, is that the fuel mixture acts as a cooling agent within the first conduit. Damage to the fuel injector components resulting from the high temperature back leaked fuel flow is significantly reduced. Similarly, deposit generation, and deformations or material degradation of the fuel injector components, resulting from the high temperatures of the back leak fuel is significantly reduced.

One benefit of the present invention as defined above, is that the length of the module is variable, such that the module may be fit to a range of different fuel injectors having differing lengths. This simplifies the manufacturing process in that only one model of electrical module is manufactured, and is adaptable for use with different fuel injectors of differing length. This is in contrast to the current methods of manufacture wherein a purpose-built module is manufactured for each different length of fuel injector. Accordingly, each different fuel injector is accompanied by its own production line of customised components, and is highly inefficient.

BRIEF DESCRIPTION OF THE DRAWINGS

In order that the invention may be more readily understood, specific embodiments of the invention will be described below, by way of example, with reference to the accompanying drawings in which.

DETAILED DESCRIPTION

In accordance with the convention adopted in the ensuing description, a fuel injector is considered as comprising a nozzle module attached to an injector body. Where the majority of the herein described embodiments are described in relation to the injector body, a short description of the nozzle module function and the injector body function ensues. This brief summary is provided for illustrative purposes only, to help the reader better appreciate the present invention. For a complete description of how the nozzle module functions, the interested reader is referred to any textbook on motor vehicle technology, such as V. A. W. Hillier & Peter Coombes' "Hillier's Fundamentals of Motor Vehicle Technology", Nelson Thornes, ISBN 0748780823, or alternatively patent publication EP1988276 (corresponding to U.S. Patent Application Publication 2008/0272214).

Figure 1A:
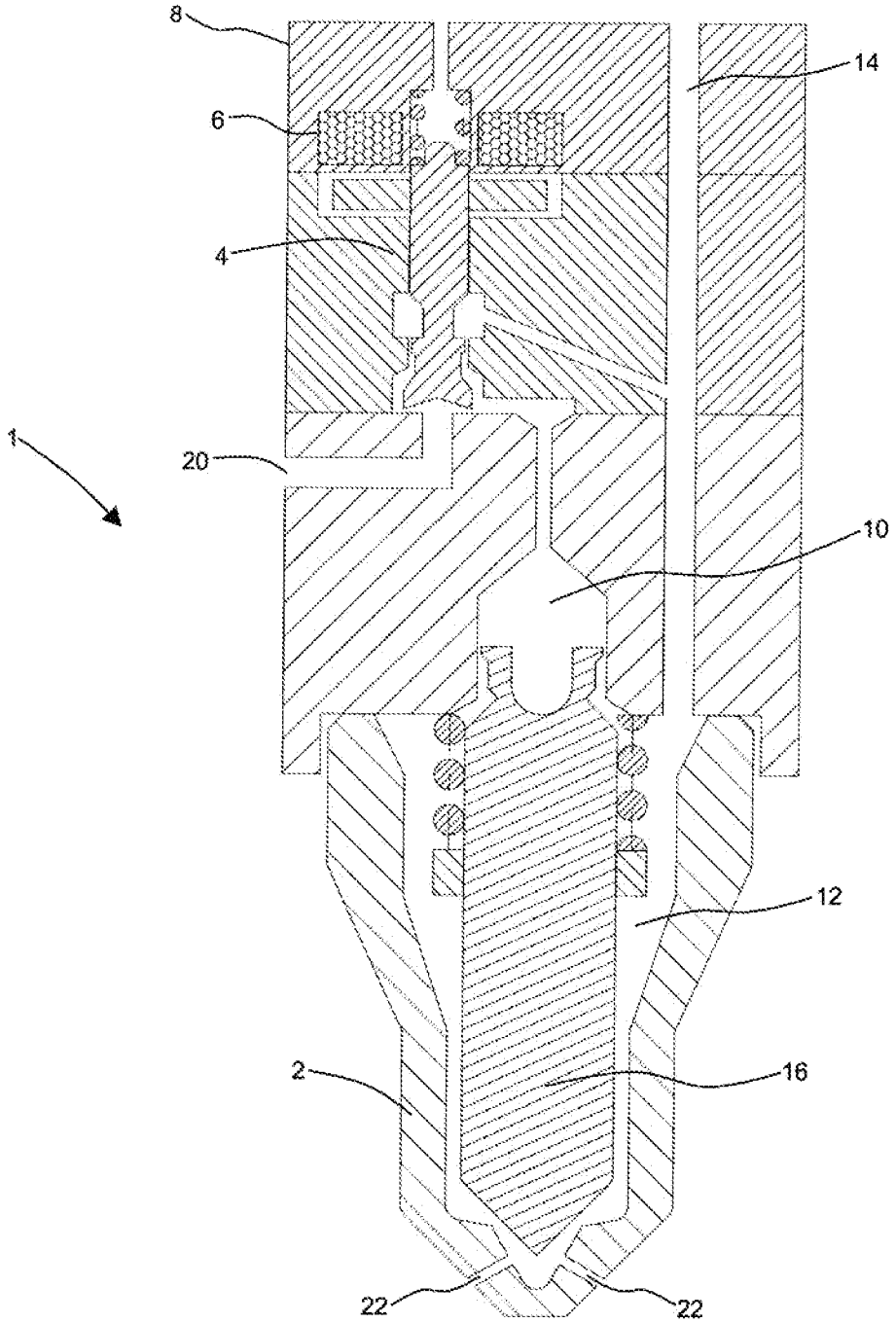
Prior Art Figure 1a
FIG. 1*a* is a schematic cross-sectional view of a conventional nozzle module of a fuel injector, in accordance with the prior art.

FIG. 1*a* is a schematic cross-sectional view of a fuel injector nozzle module 1 for use in delivering fuel to an engine cylinder or other combustion space of an internal combustion engine, as commonly used in prior art systems. The fuel injector nozzle module 1 comprises an injector nozzle 2 and a control valve 4. Operation of the control valve 4 is controlled by a piezo-electric actuator 6 located in the injector body 8, a section of which is illustrated in FIG. 1*a* (see FIG. 1*b* for a complete schematic illustration of the injector body). For clarity purposes a portion of the injector body 8 is illustrated in FIG. 1*a* however, it is to be appreciated that the injector body 8 is distinct from the nozzle module 1, in the convention adopted for the purposes of describing the present invention. The term injector body will be used throughout the present description to refer to the component of the fuel injector, which houses the electrical module and the actuator 6.

For completeness, it should be appreciated that although a piezo-electric actuator is described in the present description, the control valve may also be controlled by other means, such as by an electromagnetic actuator or a magnetorestrictive actuator. Accordingly, the present invention may be used in conjunction with fuel injectors using any type of actuator—the specific type of actuator used does not have any bearing on the present invention.

The control valve 4 is used to control the pressure within both the control chamber 10 and the nozzle chamber 12. When the control valve is closed the input of fuel via the fuel input conduit 14, which runs through the injector body 8 and into the nozzle module 1, creates a build up of pressurised fuel within both the nozzle chamber 12 and the control chamber 10, which in turn ensures the nozzle needle 16 remains in a closed position, thereby preventing the injection of fuel into the combustion chamber 18.

Fuel is injected into the combustion chamber 18 by opening the control valve 4, which is achieved by activating the actuator 6—commonly achieved by supplying electrical power to the actuator 6. The opening of the control valve 4 creates a decompression in the control chamber 10, due to the pressure difference between the nozzle chamber 12 and control chamber 10, as fuel flows from the control chamber 10 through the back leak flow conduit 20. This pressure difference results in a net force in the direction of the decompression, thereby moving the nozzle needle 16 to an open position. In the open position, the nozzle needle 16 does not obstruct the outlet openings 22, thereby allowing fuel to be injected into the combustion chamber 18.

Whilst the description of the present invention refers to a single back leak flow conduit, it is to be appreciated that the fuel injector may comprise one or more back leak flow conduits, and the herein described embodiments of the present invention are compatible with fuel injectors having several back leak flow conduits. The number of back leak flow conduits present in the fuel injector is immaterial for the purposes of the present invention.

The initiation and termination of fuel injection into the combustion chamber 18 is controlled by controlling the fuel pressure within the control chamber 10. As described above, this is achieved by selectively opening and shutting the control valve 4, by activation and deactivation of the actuator 6.

It is to be appreciated that the required decompression is generated by a volume of fuel, referred to as the back leak fuel flow, being ejected from the control chamber 10 and directed to the back leak flow conduit 20, when the control valve 4 is in an open state.

Additionally, it should be appreciated that the terms "control chamber" and "nozzle chamber" are designations used to refer to different regions of the cavity surrounding the nozzle needle, and that different topologies may be used in different fuel injectors.

Figure 1B:
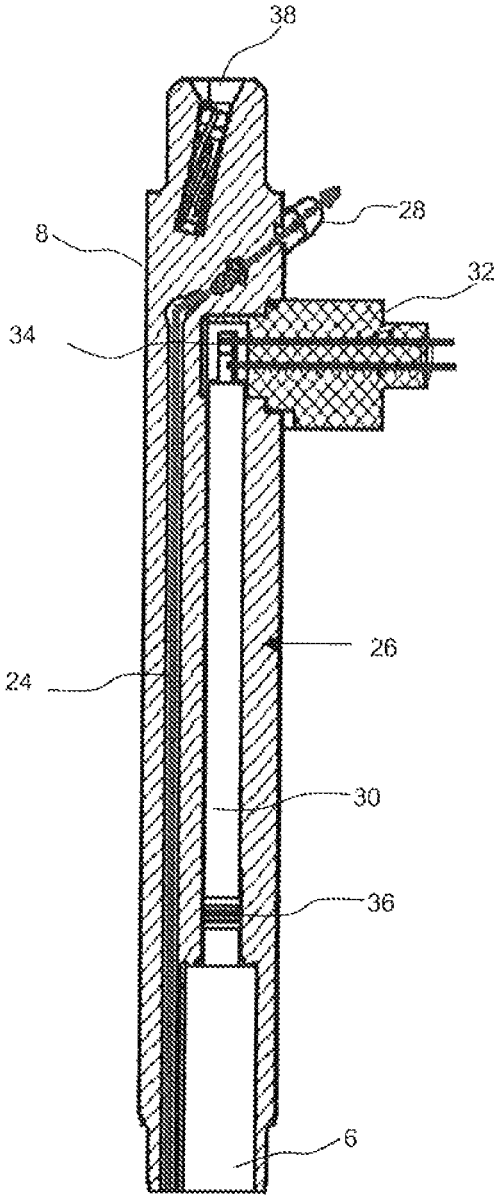
Prior Art Figure 1b
FIG. 1*b* is a schematic cross-sectional view of the injector body, in accordance with the prior art.

FIG. 1*b* is a schematic cross-sectional view of an injector body 8 commonly found in the prior art. The back leak fuel flow conduit 24 is illustrated along with the electrical module 26 used to selectively control the activation of the actuator 6. The back leak fuel flow is ejected from the injector body 8 via the back leak fuel flow outlet 28, where it is subsequently directed to the fuel management system for re-use in a subsequent injection cycle.

The electrical module 26 comprises the actuator 6, along with electrical power provisioning means 30. The electrical power provisioning means 30 may relate to conducting wires, or other electrical current conducting means. Electrical power is provided to the electrical module 26 via the electrical power plug 32, which abuts the injector body 8. The electrical module 26 is operatively connected to the power plug 32 by electrical contacts 34. The electrical plug 32 is commonly provided with a hermetic seal 36, to prevent any contact between electrical contacts 34 and leaking fuel.

Input fuel from the fuel tank for injection into the combustion chamber is input within the fuel injector body 8 via an input fuel inlet 38. The input fuel inlet 38 is connected to an input fuel conduit 14, which is not illustrated in FIG. 1*b*, and is used to deliver fuel to both the nozzle chamber 12 and the control chamber 10 via the injector body 8. For the purposes of the present invention the exact location of the input fuel inlet 38 is irrelevant.

Figure 8:
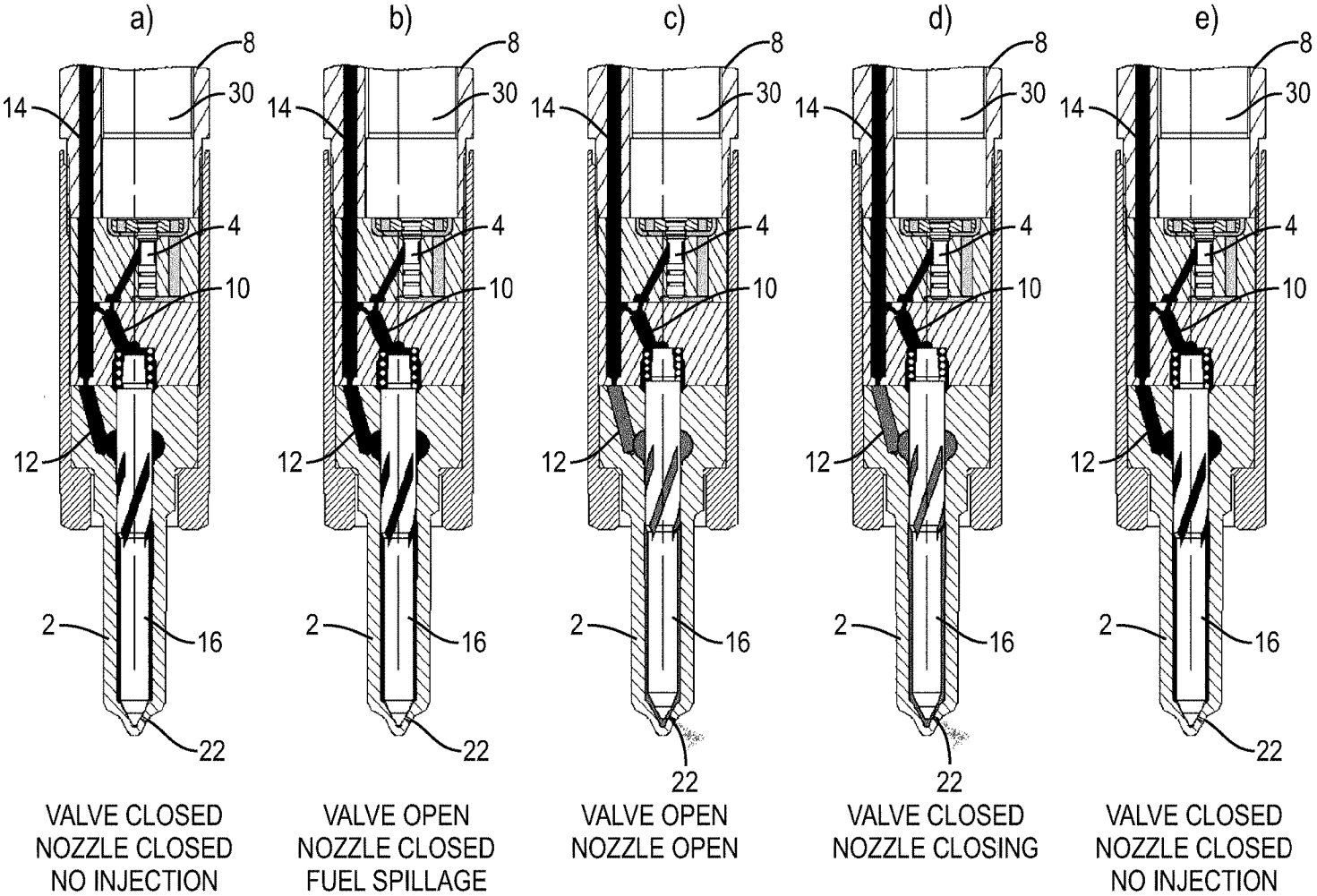
FIG. 8 is a schematic view of operation of a prior art fuel injector design, which may be adapted by use of embodiments of the invention.

Operation of a fuel injector of slightly different design is shown in FIG. 8. FIG. 8(*a*) shows the control valve 4 closed and the nozzle needle 16 closing the outlet openings 22 to close the injector nozzle 2. There is no injection at this stage, and the pressures in the nozzle chamber and control chamber are low, with the closure of the control valve 4 preventing the control chamber from depressurising. FIG. 8(*b*) shows the control valve 4 opened—at this point the nozzle needle 16 is still closing the injector nozzle, but the opening of the control valve 4 allows fuel spillage from the control chamber 10 which results in a backleak, shown here passing out through first conduit 40. This results in a pressure differential between control chamber and nozzle chamber which in due course causes the nozzle needle 16 to move away from the outlet openings 22 and injection takes place. FIG. 8(*d*) shows the control valve 4 closing again, which drives the nozzle needle 16 to close by the resulting pressure difference and hence end the injection phase. FIG. 8(*e*) shows the return to the closed state of FIG. 8(*a*).

The remaining description will focus on describing the different embodiments of the present invention and of inventive principles set out in this specification—such description is provided for illustrative purposes only. Embodiments of the invention may be provided according to the principles set out below suitable for use in the arrangements shown in FIGS. 1 and 8.

Figure 2:
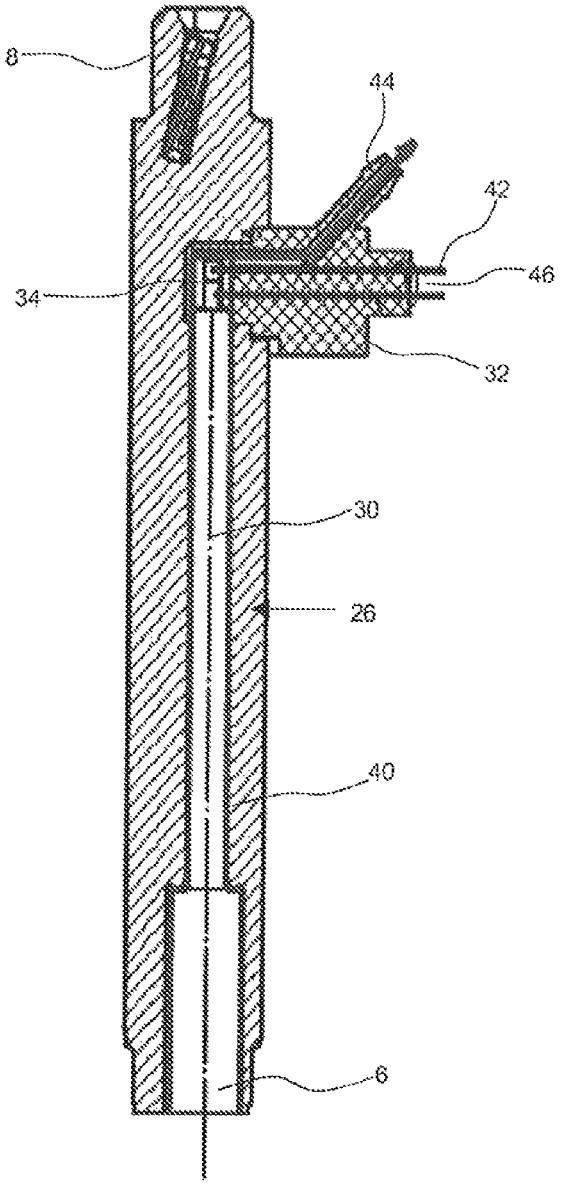
FIG. 2 is a schematic cross-sectional view of the injector body in accordance with an illustrative embodiment, wherein the first conduit is used for directing the back leak fuel flow, and the back leak fuel outlet is arranged on the electrical plug of the fuel injector.

FIG. 2 illustrates a first illustrative embodiment, wherein a first conduit 40 within the injector body 8 of a fuel injector, used for housing the electrical module 26, is also used as the back leak fuel flow conduit, thereby obviating the need for a separate purpose built back leak fuel flow conduit in the injector body 8. The electrical module 26 comprises the actuator 6 and electrical power components, the electrical power components including electrical contacts 34, and electrical connectors 30 to provision power to the actuator 6. The electrical contacts 34 of the electrical module 26 are operatively connected to the electrical contacts 42 of the power plug 32, which is abutted to the injector body 8. In operation, electrical power is provisioned to the actuator 6 via the electrical contacts 34 of the electrical module 26. In this way, the state of the control valve 4 is selectively varied between an open state and a closed state, to control the pressurisation and decompression of the control chamber 10.

During the decompression of the control chamber 10 the back leak fuel flow is directed into the first conduit 40, and is ejected from the injector body 8 through a back leak fuel outlet 44. The back leak fuel flow is subsequently recycled for use in a subsequent injection cycle by the combustion engine's fuel management system.

To facilitate the back leak fuel flow through the first conduit 40, the dimensions of the first conduit 40 are selected such that a clearance is formed between the walls of the conduit 40 and the electrical module 26. The pressure of the back leak fuel flow through the first conduit 40 will at least be partly dependent on the dimensions of this clearance. The larger the clearance, the lower the pressure of the back leak fuel flow will be, and similarly the smaller the clearance, the higher the pressure of the back leak fuel flow.

Out of safety considerations, the electrical power components including the electrical contacts 34 in the electrical module 26 are coated in an insulating material, to prevent any contact with the back leak fuel. Equally, the electrical power components may be housed in a protective housing, insulating the components from any accidental contact with the back leak fuel flow.

The injector body is provided with one or more hermetic seals to prevent accidental seepage of the back leak fuel into the abutted power plug, and into the electrical circuitry of the ECU.

FIG. 2 illustrates a second illustrative embodiment, wherein the back leak fuel outlet 44 is arranged on the power plug 32. In the illustrated embodiment the power plug performs the dual function of providing an electrical connection for the provisioning of electrical power to the actuator 6, in addition to providing a hydraulic connection for the back leak fuel flow—specifically, for returning the back leak fuel to the fuel management system. In the illustrated embodiment the placement of the hermetic seal 46 is selected to prevent the seepage of back leak fuel into the electrical circuitry of the ECU. Further hermetic seals may be located within the power plug 32 to minimise the likelihood of contact between the electrical contacts 42 and the back leak fuel flow.

Figure 3:
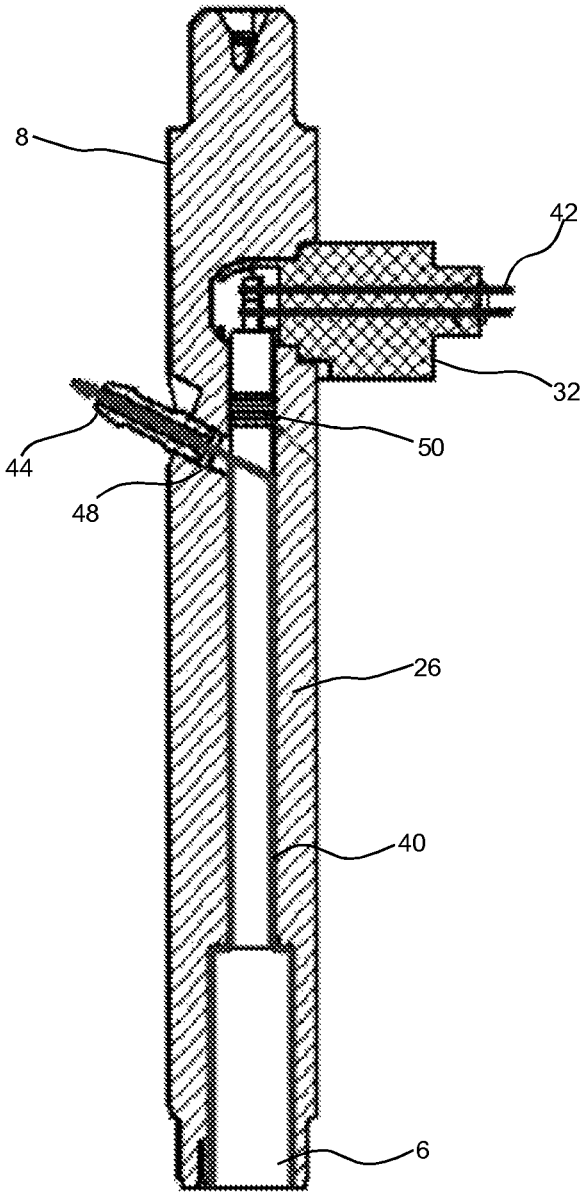
FIG. 3 is a schematic cross-sectional view of the injector body in accordance with an illustrative embodiment, wherein the first conduit is used for directing the back leak fuel flow, and the back leak fuel outlet is arrange on the injector body.

FIG. 3 illustrates an alternative embodiment, wherein the back leak fuel outlet 44 is positioned on the injector body 8. The back leaked fuel flow from the control chamber 10 is directed towards the first conduit 40, in the same manner as described above. An outlet conduit 48 forming a junction with the first conduit 40 at one end, and leading to the back leak fuel outlet 44, directs the back leak fuel flow within the first conduit 40 to the back leak fuel outlet 44, where the fuel is then recycled by the fuel management system in the same manner as previously described.

A hermetic seal 66 is arranged within the first conduit 40, placed after the junction formed by the outlet conduit 48 and the first conduit 40. The hermetic seal 66 prevents the flow of the back leak fuel into the electrical plug 32. As in the previously described embodiment, the electrical power components of the electrical module 26 are coated by an insulating material, or alternatively, are placed within a protective housing to prevent contact between the electrical power components and the back leak fuel during operation of the fuel injector.

Although the aforementioned embodiments only disclose two different examples of where the back leak fuel outlet 44 may be positioned, in practice the location of the back leak fuel outlet 44 is likely to be dictated by the topology of the engine in which the fuel injector is to be used. Accordingly, further alternative arrangements of the back leak fuel outlet 44 are envisaged. Additionally, the location of the hermetic seal 46, 66, which is required to prevent any seepage of the back leak fuel into the electrical components of the electrical plug 32, is determined on the basis of the location of the back leak fuel outlet 44.

Figure 4:
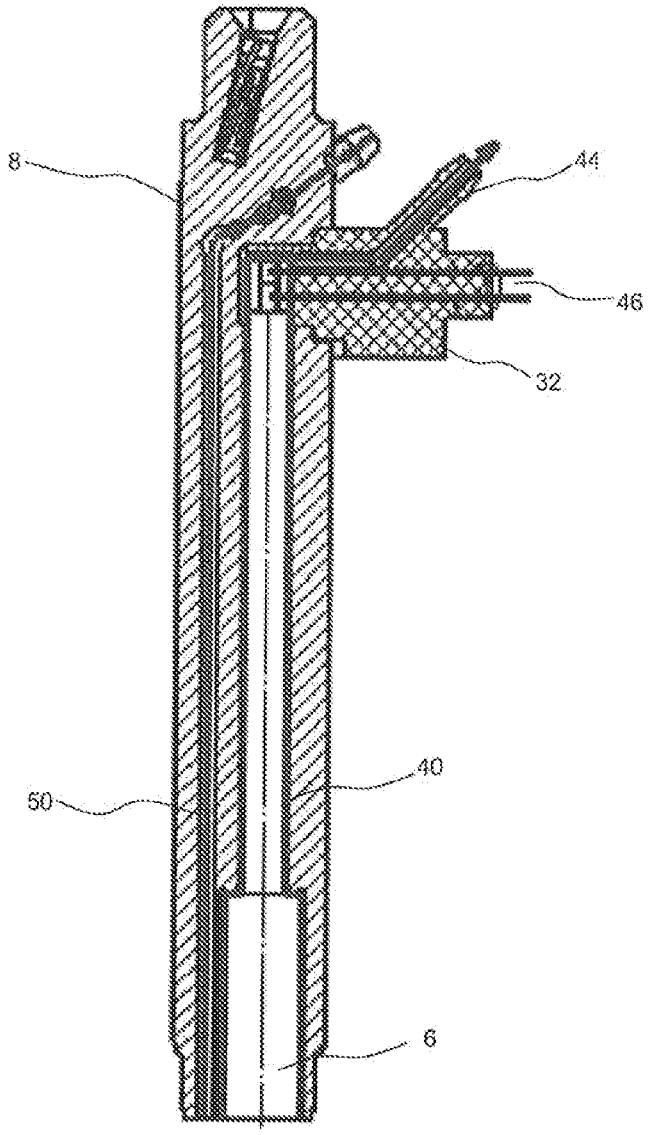
FIG. 4 is a schematic cross-sectional view of the injector body in accordance with an illustrative embodiment, wherein a second conduit is used for inputting a second fuel flow for mixing with the back leak fuel flow, and the resulting back leak fuel flow mixture is directed through the first conduit.

FIG. 4 illustrates an alternative illustrative embodiment, wherein a back leak fuel flow mixture is created by mixing the back leak fuel flow with a second fuel flow. Preferably, the second fuel flow is at a lower temperature, such that the resulting mixture has a lower temperature than the back leak fuel flow. The back leak fuel flow mixture is then directed through the first conduit 40, where it is subsequently ejected from the fuel injector and recycled for reuse by the fuel management system. In passing through the first conduit 40, the back leak fuel flow mixture performs a cooling function, since the back leak fuel flow mixture has a lower temperature than the surrounding injector components. In the present description the term back leak fuel flow is used to refer to the back leak fuel flow, which is immediately ejected from the control chamber on opening of the control valve, whereas the term back leak fuel flow mixture relates to the mixture formed by the back leak fuel flow and the input second fuel flow. The second fuel flow does not originate from the injector nozzle 2. In preferred embodiments the second fuel flow is provided directly from the fuel tank and is input directly into the injector body for mixing with the back leak fuel flow. A more detailed description of the embodiment ensues.

A second conduit 50 is machined into the injector body 8 to provide a passage through which the second fuel flow may be input into the injector body 8 for mixing with the back leak fuel flow ejected from the control chamber 10 during activation of the control valve 4. The objective of introducing the second fuel flow is to use the back leak fuel flow to cool the material surrounding the first conduit 40, in addition to cooling the electrical module 26, which includes the actuator 6. This requires that the temperature of the input second fuel flow is lower than the temperature of the back leak fuel flow. Following the creation of the back leak fuel flow mixture, the mixture is subsequently directed through the first conduit 40.

The back leak fuel flow and the input second fuel flow may be mixed within any low pressure area of the fuel injector. For example, depending on the topology of the fuel injector, the low pressure area may be located external to both the nozzle chamber and the control chamber, and is arranged in such a way that the input second fuel flow is mixed with the back leak fuel flow ejected during depressurisation of the control chamber when the actuator is in the open position. The exact location where the two fuel mixtures are mixed is selected to ensure that the pressure of the input second fuel flow is greater than the pressure of the back leak fuel flow mixture at the mixing point. This ensures that the back leak fuel flow mixture does not escape via the second fuel flow conduit 50.

Alternatively, the second fuel flow conduit 50 may be fitted with a non-return valve (also commonly referred to as a check valve, or a one-way valve) arranged to prevent any back leak fuel flow mixture from escaping via the second fuel flow conduit 50.

The required pressure of the input second fuel flow may be obtained by operatively connecting the second fuel flow conduit 50 to the one or more fuel pumps existing in the fuel management system, conventionally used to input fuel for combustion within the fuel injector.

In operation, the temperatures of the internal components of a fuel injector, and equally the temperatures of the components within the injector body 8, are predominantly determined by the temperature of the high pressure input fuel. The flow of the lower temperature back leak fuel mixture through the first conduit 40 has the desired effect of cooling/decreasing the temperature of the injector's internal components.

The back leak fuel mixture is ejected from the first conduit 40 via a back leak fuel flow outlet 44. The position of the back leak fuel flow outlet 44 will be dependent on the topology of the engine in which the fuel injector is to be used. For example, and as described in the aforementioned embodiments, the back leak fuel flow outlet 44 may be positioned, alternatively on the power plug 32 abutted to the injector body 8, as illustrated in FIG. 4, or on the injector body 8 itself via an outlet conduit 44 as illustrated for the embodiment of FIG. 3. Similarly the location of the hermetic seal 46, 66, required to prevent seepages of fuel into the electrical components within the power plug 32, and/or the electrical circuitry of the ECU, is selected on the basis of the position of the back leak flow outlet 44.

In one illustrative embodiment, the second fuel flow may be input into the second conduit 50, at a periodic frequency, which may be regulated by the ECU, and will be proportional to the rate at which fuel is input into the fuel injector for combustion, and to the rate at which the back leak fuel flow is generated. Accordingly, in the embodiment illustrated in FIG. 4, the operational temperatures of the components of the fuel injector are lower than the equivalent operating temperatures for fuel injectors not featuring an input second, lower temperature/pressure fuel flow. Lower operational temperatures positively increase the operational lifetime of the fuel injector. For example, the formation of sedimentary deposits, deformations and degradation of the materials within the fuel injectors are all reduced, thereby improving the performance of the actuator over time. Furthermore, the lifespan of the electrical module is significantly improved by maintaining the fuel injector and the electrical module at a lower operating temperature. In particular the lifespan of the windings in the actuator is increased by maintaining a lower operational temperature. Equally, wear to the plastic claddings of the electrical module is reduced.

In an alternative embodiment, the second fuel flow is input into the second conduit 50, at a constant rate. Such an embodiment does not require any specific monitoring by the ECU.

Alternatively, the rate at which the second fuel flow is input into the second conduit 50 may be regulated and varied depending on whether cooling is required. In such embodiments, it is envisaged that the ECU may feature a control system which monitors the operating temperatures of the fuel injector components, and on the basis of the measured temperature decides if cooling is required. For example, if a pre-established threshold temperature is reached, the ECU may initiate cooling by inputting the second fuel flow into the fuel injector.

The performance of piezo-electric actuators is negatively compromised by high operating temperatures, due to the decreased electrical power being delivered to the actuator, resulting from the increased electrical resistance in the electrical power components operatively connected to the piezo-electric actuator.

In embodiments where the actuator is an electromagnetic solenoid, a decrease in magnetic performance at high operating temperatures is also often observed primarily as a result of the decrease in mechanical robustness of the windings in the actuator with increasing temperature.

Maintaining a lower operating temperature within the fuel injector improves the operation of the injector, by improving the performance of the actuator.

Figure 5:
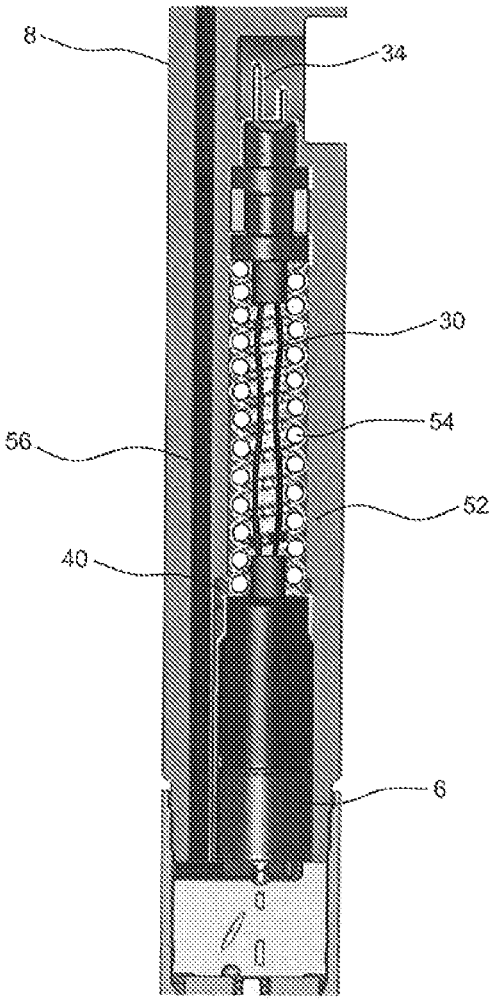
FIG. 5 is a schematic cross-sectional view of the injector body in accordance with an embodiment of the present invention, wherein the electrical module is variable in length, the body comprising a compressible coil spring.

FIG. 5 illustrates an electrical module 52, wherein the length of the module is adjustable, in accordance with an embodiment of the present invention. The electrical module 52 comprises an actuator 6, electrical power components, including electrical contacts 34 for operatively connecting the module to the electrical power plug 32 (not illustrated in FIG. 5) abutted to the injector body 8. The body of the module is variable in length, and in a preferred embodiment is comprised of a compressible coil spring 54—the length being variable by selectively compressing the coil spring 54 by the required amount for fitting the module 52 into the first conduit 40 of the required fuel injector. In preferred embodiments, the electrical power components include electrical conductors 30 as power provisioning means. These may be electrically conductive wires, which are arranged within the compressible coil spring 54, for the provisioning of electrical power to the actuator 6.

The maximum length of the electrical module 52 is proportional to the uncompressed coil spring 54 length. The electrically conductive wires are fit to the electrical module 52 when the coil spring 54 is in the uncompressed state. Accordingly, the length of the electrically conductive wires are determined on the basis of the uncompressed coil spring length. In this way regardless of the operational length of the electrical module 52 when inserted within the fuel injector, an electrical connection may always be established.

During manufacture, the coil spring 54 is compressed by at least the amount required to fit the module 52 in the first conduit 40 of the fuel injector—typically, it will be fully compressed on insertion. Use of the coil spring 54 as the body of the electrical module 52 allows production of the electrical module 52 to be streamlined. The same electrical module 52 model may be fit to several different lengths of fuel injector—this may require the electrical leads to vary in lengths between models (to ensure that the electrical connection is not affected by compression and expansion of the coil spring on assembly). This provides a significant advantage to manufacturers—rather than running several different production lines of electrical module, only one production line for the variable-length electrical module 52 is required.

Although FIG. 5 illustrates the back leak flow conduit 56 as being separate to the first conduit, it is envisaged that the variable-length electrical module 52 may be used in conjunction with any of the aforementioned illustrative embodiments. For example, the variable-length electrical module 52 may be used in conjunction with the above described embodiments where the first conduit 40 is used to direct the back leak fuel flow out of the injector. In such embodiments the power provisioning means 30, which may relate to electrically conducting wires, are coated in an insulating material to prevent contact between the back leak fuel flow and the power provisioning means 30.

Figure 6:
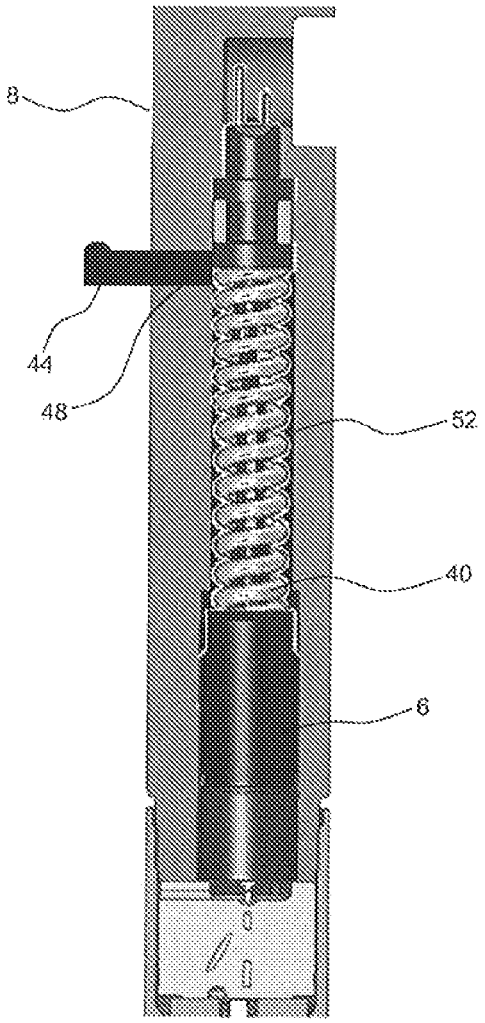
FIG. 6 is a schematic cross-sectional view of the injector body in accordance with an embodiment of the present invention, wherein the electrical module is variable in length, the body comprising a compressible coil spring, and the back leak fuel flow is directed through the first conduit to a back leak fuel outlet located on the injector body.

FIG. 6 illustrates an embodiment of the present invention comprising a variable-length electrical module 52, where the first conduit 40 is used for directing the back leak fuel flow to a back leak fuel outlet 44 abutted to the injector body 8 via an outlet conduit 48 forming a junction with the first conduit 40.

Figure 7:
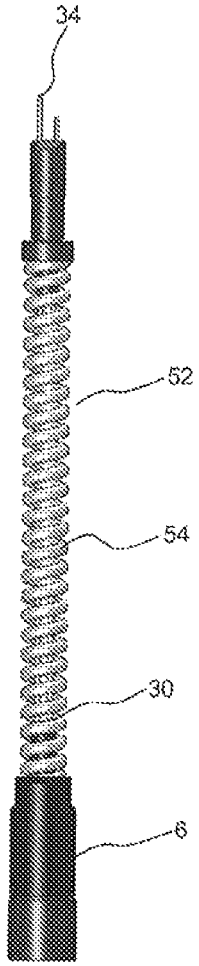
FIG. 7 is a schematic view of the electrical module in accordance with an embodiment of the present invention, wherein the body of the module comprises a compressible coil spring.

FIG. 7 illustrates the variable-length electrical module 52, used in accordance with embodiments of the present invention. As previously described, the body of the module comprises a compressible coil spring 54. The electrical power provisioning means 30 (i.e. the electrically conductive wires) are arranged within the coil spring 54. In preferred embodiments, the actuator 6 is located at one end of the coil spring 54, whilst the electrical contacts 34 are located at the opposite end of the coil spring 54.

Equally, the variable-length electrical module embodiment may be used in conventional prior art fuel injectors featuring a back leak fuel conduit, which is separate to the first conduit.

In alternative embodiments, the coil spring 54 may be replaced with any elastic element, such as a variable length spring washer. The operation of such a variable length electrical module is identical to the previously described embodiment.

The herein described embodiments are for illustrative purposes only, it is to be appreciated that any combination of the elements herein described embodiments is envisaged, and falls within the scope of the present invention.

The invention claimed is:

1. A fuel injector for use in delivering fuel to an internal combustion engine, the fuel injector comprising:

an injector body, the injector body comprising a first conduit through which fuel flows; an electrical module arranged within the first conduit, the electrical module being of variable length and comprising electrical contacts for operatively connecting the electrical module to a power plug of the fuel injector, an actuator for operatively controlling a control valve disposed within the fuel injector, and electrical conductors arranged within a protective housing, the electrical conductors providing an electrical connection between the electrical contacts and the actuator, to provide electrical power to the actuator when the electrical contacts are operatively connected to the power plug of the fuel injector, wherein the body of the electrical module is comprised of a compressible elastic element, such that the length of the electrical module is variable by compressing the elastic element; and a power plug for providing electrical power to the fuel injector; wherein the injector body is disposed within the fuel injector such that a back leak channel from the fuel injector passes through at least a part of the first conduit;

and wherein the injector body is provided with a second conduit, the second conduit being arranged in use to provide an input passage through the injector body for a second fuel flow, the second fuel flow being for use in mixing with a back leak fuel flow to form a back leak fuel flow mixture; and wherein the back leak fuel flow mixture is directed through at least a part of the first conduit.

2. The fuel injector of claim 1, wherein the width of the first conduit is selected such that a clearance is formed between the walls of the first conduit and the electrical module to allow the passage of a back leaked fuel flow through the formed clearance.

3. The fuel injector of claim 1, wherein the back leak fuel mixture comprises a back leak fuel flow generated within the fuel injector by opening of a control valve; and the input second fuel flow provided by a fuel source located external to the fuel injector.

4. The fuel injector of claim 1, wherein the back leak fuel flow mixture is for use in cooling one or more of the following:

a) the electrical module;

b) the actuator;

c) the injector body.

5. The fuel injector of claim 1, wherein a back leak fuel flow outlet from the back leak channel is positioned on the power plug, the power plug having a hermetic seal to prevent contact between the back leaked fuel flow and any electrical connections within the power plug.

6. The fuel injector of claim 1, wherein a back leak fuel flow outlet from the back leak channel is positioned on the injector body, and the injector body is disposed with a third conduit joined to the first conduit, the back leak channel extending from the first conduit via the third conduit; wherein the first conduit is disposed with a hermetic seal to prevent the passage of back leaked fuel from the first conduit to the power plug.

7. A fuel injector as claimed in claim 1 wherein the elastic element is a coil spring.

8. A fuel injector as claimed in claim 1 wherein the elastic element is a spring washer.

9. A fuel injector as claimed in claim 1, wherein the width of the first conduit is selected such that a clearance is formed between the walls of the first conduit and the electrical module to allow the passage of a back leaked fuel flow through the formed clearance, wherein the injector body is provided with a second conduit, the second conduit being arranged in use to provide an input passage through the injector body for a second fuel flow, the second fuel flow being for use in mixing with a back leak fuel flow to form a back leak fuel flow mixture; and wherein the back leak fuel flow mixture is directed through at least a part of the first conduit.

10. A fuel injector as claimed in claim 9, wherein the back leak fuel mixture comprises a back leak fuel flow generated within the fuel injector by opening of a control valve; and the input second fuel flow provided by a fuel source located external to the fuel injector.

11. A fuel injector as claimed in claim 3, wherein the back leak fuel flow mixture is for use in cooling one or more of the following:

a) the electrical module;

b) the actuator;

c) the injector body.

12. A fuel injector as claimed in claim 1, wherein a back leak fuel flow outlet from the back leak channel is positioned on the power plug, the power plug having a hermetic seal to prevent contact between the back leaked fuel flow and any electrical connections within the power plug.

13. A fuel injector as claimed in claim 1, wherein a back leak fuel flow outlet from the back leak channel is positioned on the injector body, and the injector body is disposed with a third conduit joined to the first conduit, the back leak channel extending from the first conduit via the third conduit; wherein the first conduit is disposed with a hermetic seal to prevent the passage of back leaked fuel from the first conduit to the power plug.

* * * * *